US009503831B2

(12) United States Patent
Chen

(10) Patent No.: US 9,503,831 B2
(45) Date of Patent: Nov. 22, 2016

(54) AUDIO PLAYBACK METHOD AND APPARATUS

(71) Applicant: Huawei Technologies Co., Ltd., Shenzhen (CN)

(72) Inventor: Xi Chen, Nanjing (CN)

(73) Assignee: Huawei Technologies Co., Ltd., Shenzhen (CN)

( * ) Notice: Subject to any disclaimer, the term of this patent is extended or adjusted under 35 U.S.C. 154(b) by 174 days.

(21) Appl. No.: 14/489,735

(22) Filed: Sep. 18, 2014

(65) Prior Publication Data

US 2015/0003647 A1 Jan. 1, 2015

Related U.S. Application Data

(63) Continuation of application No. PCT/CN2013/088064, filed on Nov. 28, 2013.

(30) Foreign Application Priority Data

May 22, 2013 (CN) ..... 2013 1 0194267

(51) Int. Cl.

| | |
|---|---|
| ***H04R 5/00*** | (2006.01) |
| ***H04S 1/00*** | (2006.01) |
| ***H04R 5/04*** | (2006.01) |

(52) U.S. Cl.

CPC . *H04S 1/00* (2013.01); *H04R 5/04* (2013.01); *H04R 2205/024* (2013.01); *H04R 2420/03* (2013.01); *H04R 2499/11* (2013.01)

(58) Field of Classification Search

CPC ..... H04R 5/04; H04R 2205/024; H04R 2499/11; H04R 2420/03; H04S 1/00

USPC ..... 381/300, 302, 303, 306, 307, 182

See application file for complete search history.

(56) References Cited

U.S. PATENT DOCUMENTS

2007/0098191 A1 5/2007 Wan et al.
2010/0008523 A1* 1/2010 Demuynck ..... G06F 1/1616 381/182

(Continued)

FOREIGN PATENT DOCUMENTS

CN 1979410 A 6/2007
CN 102550047 A 7/2012

(Continued)

OTHER PUBLICATIONS

Partial English Translation and Abstract of Chinese Patent Application No. CN1979410A, Sep. 12, 2014, 17 pages.
Partial English Translation and Abstract of Chinese Patent Application No. CN102595304A, Sep. 12, 2014, 13 pages.

(Continued)

*Primary Examiner* — Melur Ramakrishnaiah
(74) *Attorney, Agent, or Firm* — Conley Rose, P.C.

(57) ABSTRACT

Embodiments of the present invention provide an audio playback method and apparatus. The embodiments of the present invention provide an audio playback method, applied to a mobile terminal that has a spatial attitude sensor, where the mobile terminal includes at least three speakers, and the at least three speakers are not in a same straight line, where the method includes: when screen rotation is performed on the mobile terminal, acquiring spatial attitude information; and controlling, according to the spatial attitude information, audio content played by each speaker, so that a speaker located on the left of currently played video information plays a left audio channel, and a speaker located on the right of the currently played video information plays a right audio channel. The audio playback method and apparatus provided in the embodiments of the present invention can be applied to the mobile terminal having the spatial attitude sensor.

8 Claims, 6 Drawing Sheets

(56) References Cited

U.S. PATENT DOCUMENTS

| | | | | |
|---|---|---|---|---|
| 2012/0051567 | A1* | 3/2012 | Castor-Perry | H04R 29/002 381/304 |
| 2013/0038726 | A1 | 2/2013 | Kim | |

FOREIGN PATENT DOCUMENTS

| | | | | |
|---|---|---|---|---|
| CN | 102595304 | A | 7/2012 | |
| CN | 202711124 | U | 1/2013 | |
| CN | 103000179 | A | 3/2013 | |
| CN | 103295610 | A | 9/2013 | |
| DE | 102011052098 | B3 * | 1/2013 | H04R 3/12 |

OTHER PUBLICATIONS

Partial English Translation and Abstract of Chinese Patent Application No. CN103295610A, Sep. 12, 2014, 8 pages.

Partial English Translation and Abstract of German Patent Application No. DE102011052098B3, Sep. 16, 2014, 32 pages.

Foreign Communication From a Counterpart Application, PCT Application No. PCT/CN2013/088064, International Search Report dated Mar. 13, 2014, 9 pages.

Foreign Communication From a Counterpart Application, PCT Application No. PCT/CN2013/088064, Written Opinion dated Mar. 13, 2014, 7 pages.

* cited by examiner

AUDIO PLAYBACK METHOD AND APPARATUS

CROSS-REFERENCE TO RELATED APPLICATIONS

This application is a continuation of International Application No. PCT/CN2013/088064, filed on Nov. 28, 2013, which claims priority to Chinese Patent Application No. 201310194267.4, filed on May 22, 2013, both of which are hereby incorporated by reference in their entireties.

TECHNICAL FIELD

The present invention relates to the field of audio playback, and in particular, to an audio playback method and apparatus.

BACKGROUND

With social development, an increasing number of multimedia files are played on mobile terminals. In a playback process, because a direction of an audio signal output by an audio channel is fixed, how to enable quality of audio signal playback to vary with change of a spatial attitude of a mobile terminal becomes a to-be-solved problem. In the prior art, a mobile terminal uses dual speakers to play audio signals, with a left audio channel fixedly playing an audio signal and with a right audio channel fixedly playing another audio signal, so as to achieve a stereophonic effect.

A mobile terminal such as a mobile phone or a tablet computer may be used for playing a multimedia file, and a played multimedia file is formed, in most cases, by two parts: audio information and video information.

Currently, in most cases, a mobile terminal is provided with dual speakers, and for the mobile terminal, the dual speakers are disposed on the left and right of the mobile terminal separately. A left audio channel of audio information is played by a speaker on the left of the mobile terminal, and at the same time, a right audio channel of the audio information is played by a speaker on the right of the mobile terminal, so as to achieve a stereophonic effect. An audio channel refers to audio signals which are independent of each other and collected or played back at different spatial locations when sound is recorded or played. The left audio channel is an audio track through which a signal in a low audio area passes when the signal in the low audio area is played after being compressed, and is sound output generated by simulating a hearing range of the left ear of a human being, while the right audio channel is opposite to the left audio channel.

In the implementation of embodiments of the present invention, the inventor finds that the prior art has at least the following problems:

In a process of playing the multimedia file, the spatial attitude of the mobile terminal may change, and the video information may vary with the change of the spatial attitude of the mobile terminal; however, the audio information played by the dual speakers is fixed, so that audio information that should be played by the speaker on the right of the mobile terminal is wrongly output by the speaker on the left of the mobile terminal, which leads to a mismatch between the output audio information and the video information displayed by the mobile terminal.

SUMMARY

Embodiments of the present invention provide an audio playback method and apparatus, so as to solve the problem in the prior art that audio information output by a mobile terminal does not match video information displayed by the mobile terminal because a spatial attitude of the mobile terminal changes in a process of playing a multimedia file.

To achieve the foregoing objective, the embodiments of the present invention use the following technical solutions:

According to a first aspect, an embodiment of the present invention provides an audio playback method, including: when screen rotation is performed on a mobile terminal, acquiring spatial attitude information, where the spatial attitude information is information generated according to spatial attitude location information of the mobile terminal that is collected by a spatial attitude sensor; and controlling, according to the spatial attitude information, audio content played by each speaker, so that a speaker located on the left of currently played video information plays a left audio channel, and a speaker located on the right of the currently played video information plays a right audio channel.

In a first possible implementation manner, with reference to the first aspect, the controlling, according to the spatial attitude information, audio content played by each speaker includes: selecting at least one pair of speakers from at least three speakers according to the spatial attitude information; and controlling a first speaker in the at least one pair of speakers to play the left audio channel, and controlling a second speaker in the at least one pair of speakers to play the right audio channel, where the first speaker is located on the left of the currently played video information, and the second speaker is located on the right of the currently played video information.

In a second possible implementation manner, with reference to the first possible implementation manner of the first aspect, the controlling, according to the spatial attitude information, audio content played by each speaker further includes: if the at least three speakers include a remaining speaker in addition to the at least one pair of speakers, controlling the remaining speaker so that the remaining speaker is muted.

In a third possible implementation manner, with reference to the first aspect, the controlling, according to the spatial attitude information, audio content played by each speaker includes: acquiring a spatial attitude change rate, and determining, according to the spatial attitude change rate and a preset rate threshold, whether a spatial attitude of the mobile terminal changes slowly; and if the spatial attitude of the mobile terminal changes slowly, controlling, according to the spatial attitude information and the spatial attitude change rate, volume of the left audio channel or the right audio channel that is played by each speaker in the at least three speakers, so that intensities of sound fields on the left and the right of the currently played video information keep equal in a volume change process.

In a fourth possible implementation manner, with reference to the first aspect or any one of the first to the third possible implementation manners of the first aspect, the spatial attitude information includes an angle, angular acceleration, and an angle change rate.

According to a second aspect, an embodiment of the present invention provides a mobile terminal, including a spatial attitude sensor and at least three speakers, where the at least three speakers are not in a same straight line, and the mobile terminal further including: an acquiring unit configured to, when screen rotation is performed on the mobile terminal, acquire spatial attitude information, where the spatial attitude information is information generated according to spatial attitude location information of the mobile terminal that is collected by the spatial attitude sensor; and a control unit configured to control, according to the spatial attitude information acquired by the acquiring unit, audio content played by each speaker, so that a speaker located on the left of currently played video information plays a left audio channel, and a speaker located on the right of the currently played video information plays a right audio channel.

In a first possible implementation manner, with reference to the second aspect, the control unit includes: a selecting subunit configured to select at least one pair of speakers from the at least three speakers according to the spatial attitude information acquired by the acquiring unit; and a first executing subunit configured to control a first speaker in the at least one pair of speakers selected by the selecting subunit to play the left audio channel, and control a second speaker in the at least one pair of speakers to play the right audio channel, where the first speaker is located on the left of the currently played video information, and the second speaker is located on the right of the currently played video information.

In a second possible implementation manner, with reference to the first possible implementation manner of the second aspect, the control unit further includes: a second executing subunit configured to, if the at least three speakers include a remaining speaker in addition to the at least one pair of speakers selected by the selecting subunit, control the remaining speaker so that the remaining speaker is muted.

In a third possible implementation manner, with reference to the second aspect, the control unit includes: an acquiring subunit configured to acquire a spatial attitude change rate; a determining subunit configured to determine, according to the spatial attitude change rate acquired by the acquiring subunit and a preset rate threshold, whether a spatial attitude of the mobile terminal changes slowly; and a third executing subunit configured to, if the determining subunit determines that the spatial attitude of the mobile terminal changes slowly, control, according to the spatial attitude information and the spatial attitude change rate, volume of the left audio channel or the right audio channel that is played by each speaker in the at least three speakers, so that intensities of sound fields on the left and the right of the currently played video information keep equal in a volume change process.

In a fourth possible implementation manner, with reference to the second aspect or any one of the first to the third possible implementation manners of the second aspect, the spatial attitude information includes an angle, angular acceleration, and an angle change rate.

Embodiments of the present invention provide an audio playback method and apparatus. When screen rotation is performed on a mobile terminal, spatial attitude information is acquired, and audio content played by each speaker is controlled according to the spatial attitude information, so that a speaker located on the left of currently played video information plays a left audio channel, and a speaker located on the right of the currently played video information plays a right audio channel; in this way, the video information and the audio content that are currently played always correspond to each other. Compared with the prior art, the embodiments of the present invention control, by acquiring the spatial attitude information of the mobile terminal, the audio content played by each speaker, so that the video information and the audio content that are currently played by the mobile terminal always correspond to each other, thereby resolving the problem in the prior art that the video information and the audio content that are currently played by the mobile terminal do not match when screen rotation is performed on the mobile terminal.

DESCRIPTION OF EMBODIMENTS

The following clearly describes the technical solutions in the embodiments of the present invention with reference to the accompanying drawings in the embodiments of the present invention. The described embodiments are merely a part rather than all of the embodiments of the present invention. All other embodiments acquired by a person of ordinary skill in the art based on the embodiments of the present invention without creative efforts shall fall within the protection scope of the present invention.

Embodiments of the present invention provide an audio playback method and apparatus, so as to solve the problem in the prior art that video information and audio content that are currently played by a mobile terminal do not match when screen rotation is performed on the mobile terminal. The audio playback method and apparatus provided in the embodiments of the present invention are described below in detail with reference to the accompanying drawings.

Figure 1A:
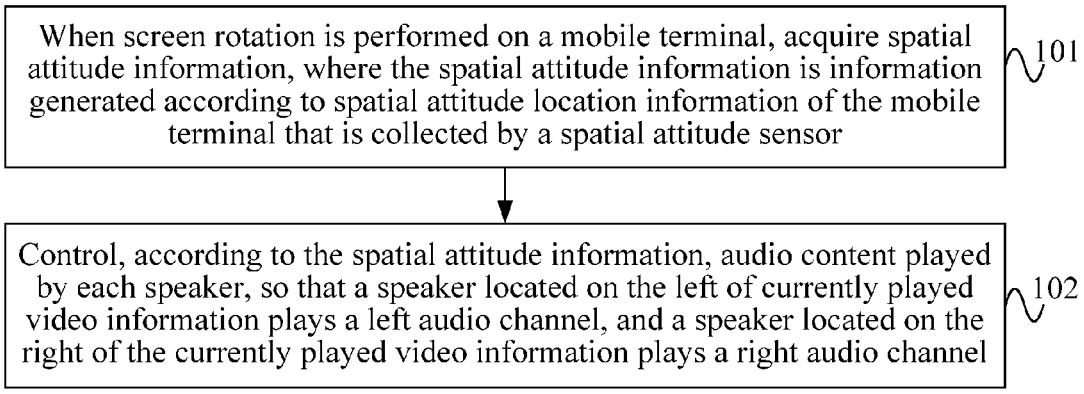
FIG. 1A is a flowchart of an audio playback method according to an embodiment of the present invention.

As shown in FIG. 1A, an audio playback method provided in an embodiment of the present invention is applied to a mobile terminal that has a spatial attitude sensor, where the mobile terminal includes at least three speakers, and the at least three speakers are not in a same straight line; and the method includes:

Step 101: When screen rotation is performed on the mobile terminal, acquire spatial attitude information, where the spatial attitude information is information generated according to spatial attitude location information of the mobile terminal that is collected by the spatial attitude sensor.

The spatial attitude information includes an angle, angular acceleration, and an angle change rate; and the spatial attitude sensor includes, but is not limited to, a gravity sensor, a magnetic sensor, and the like.

Step 102: Control, according to the spatial attitude information, audio content played by each speaker, so that a speaker located on the left of currently played video information plays a left audio channel, and a speaker located on the right of the currently played video information plays a right audio channel.

Figure 1B:
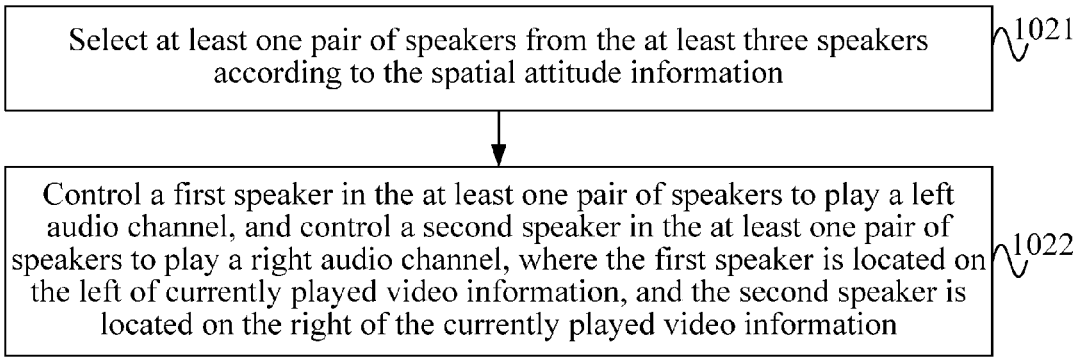
FIG. 1B is a flowchart of step 102 in the flowchart shown in FIG. 1 according to the present invention.

As shown in FIG. 1B, step 102 includes:

Step 1021: Select at least one pair of speakers from the at least three speakers according to the spatial attitude information.

Step 1022: Control a first speaker in the at least one pair of speakers to play the left audio channel, and control a second speaker in the at least one pair of speakers to play the right audio channel, where the first speaker is located on the left of the currently played video information, and the second speaker is located on the right of the currently played video information.

Optionally, to prevent that matching of the video information and the audio content cannot be achieved even by directly switching the left audio channel and the right audio channel as a result from slow change of a spatial attitude of the mobile terminal, the controlling, according to the spatial attitude information, audio content played by each speaker may further include: acquiring a spatial attitude change rate, and determining, according to the spatial attitude change rate and a preset rate threshold, whether the spatial attitude of the mobile terminal changes slowly; and if the spatial attitude of the mobile terminal changes slowly, controlling, according to the spatial attitude information and the spatial attitude change rate, volume of the left audio channel or the right audio channel that is played by each speaker in the at least three speakers.

In the audio playback method provided in the embodiment of the present invention, when screen rotation is performed on a mobile terminal, spatial attitude information is acquired, and audio content played by each speaker is controlled according to the spatial attitude information, so that a speaker located on the left of currently played video information plays a left audio channel, and a speaker located on the right of the currently played video information plays a right audio channel; in this way, the video information and the audio content that are currently played always correspond to each other. Compared with the prior art, the present invention controls, by acquiring the spatial attitude information of the mobile terminal, the audio content played by each speaker, so that the video information and the audio content that are currently played by the mobile terminal always correspond to each other, thereby resolving the problem in the prior art that the video information and the audio content that are currently played by the mobile terminal do not match when screen rotation is performed on the mobile terminal.

To make a person skilled in the art understand the technical solutions provided in the embodiments of the present invention more clearly, an audio playback method provided in another embodiment of the present invention is described herein in detail.

Figure 2:
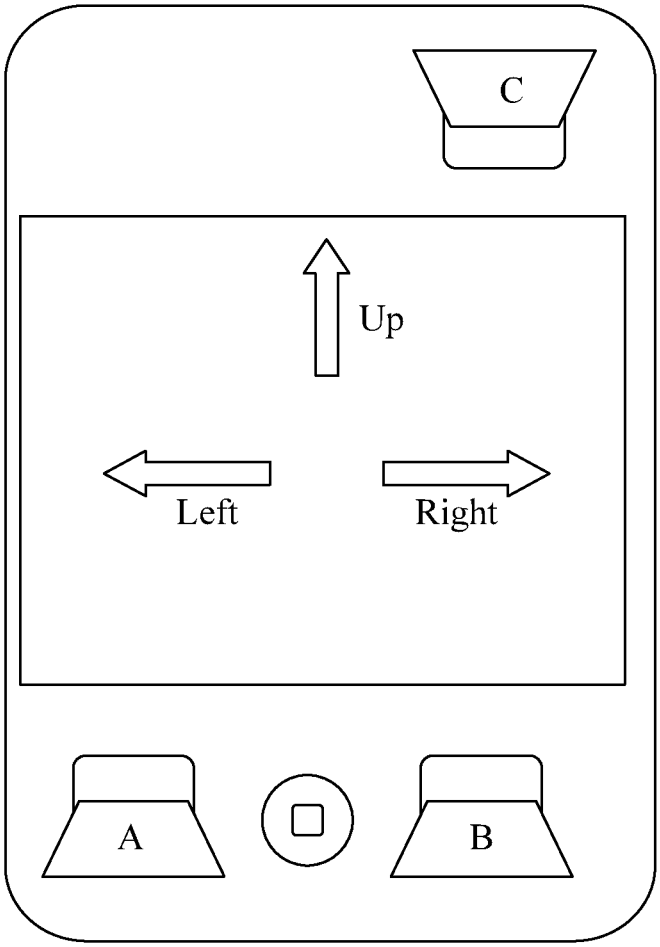
FIG. 2 is a first schematic diagram of an attitude of a mobile terminal implementing an audio playback method according to another embodiment of the present invention.
Figure 3:
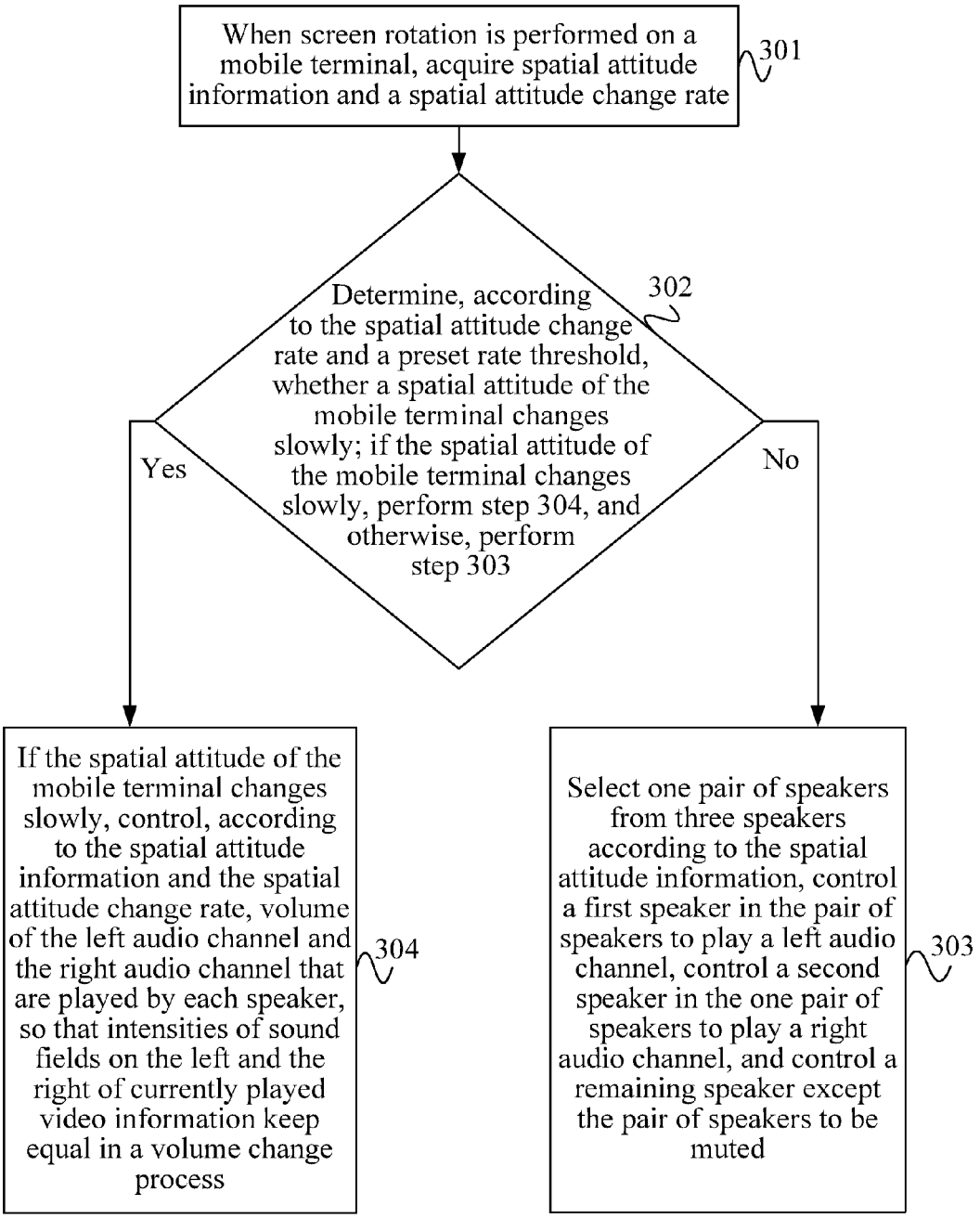
FIG. 3 is a flowchart of an audio playback method according to another embodiment of the present invention.

The audio playback method provided in another embodiment of the present invention is applied to a mobile terminal, where the mobile terminal includes a gravity sensor and three speakers, and the three speakers are a speaker A, a speaker B, and a speaker C; as shown in FIG. 2, in the case of an attitude 1, the speaker A is located on the lower left of the mobile terminal, the speaker B is located on the lower right of the mobile terminal, and the speaker C is located on the upper right of the mobile terminal. As shown in FIG. 3, the audio playback method includes:

Step 301: When screen rotation is performed on the mobile terminal, acquire spatial attitude information and a spatial attitude change rate.

Figure 4:
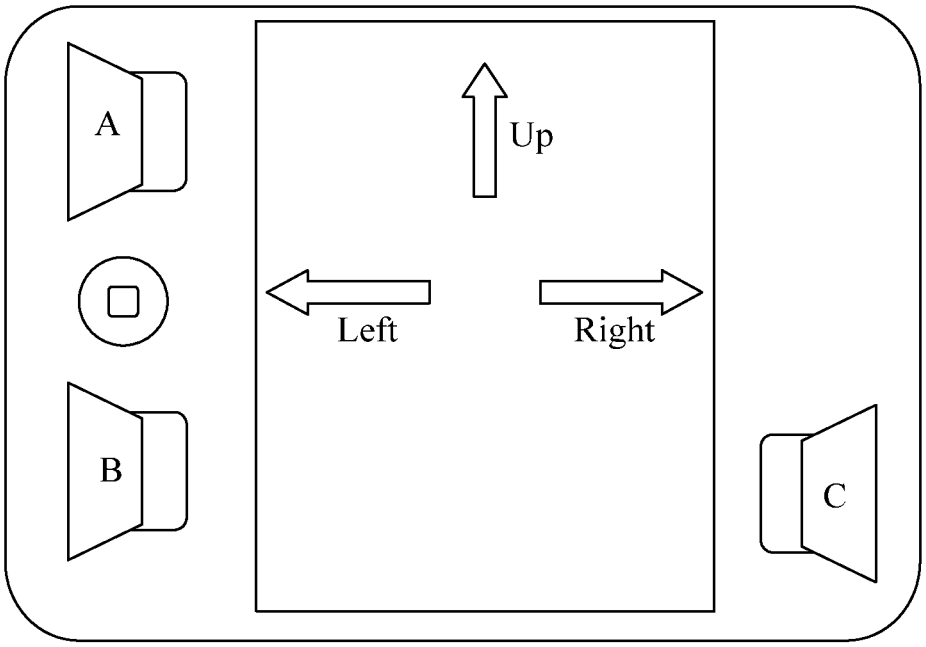
FIG. 4 is a second schematic diagram of an attitude of a mobile terminal implementing an audio playback method according to another embodiment of the present invention.
Figure 5:
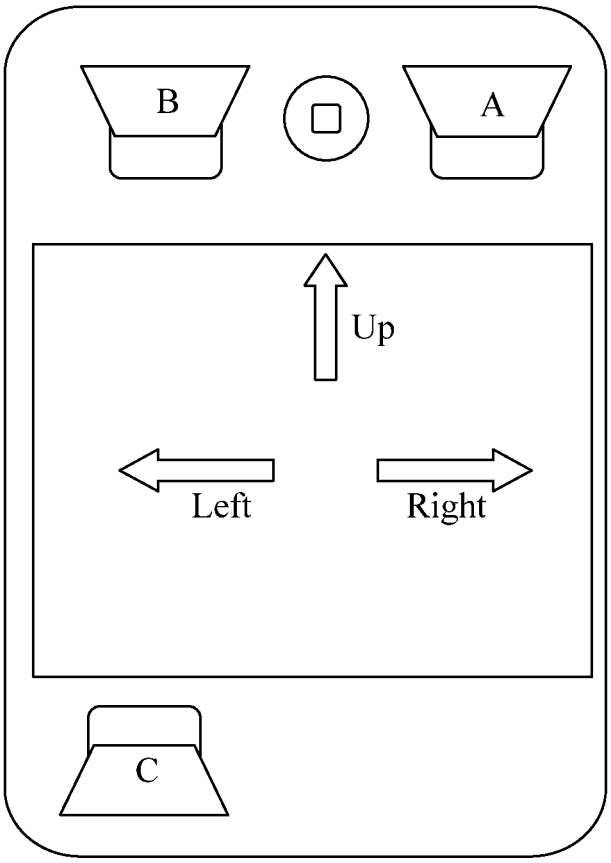
FIG. 5 is a third schematic diagram of an attitude of a mobile terminal implementing an audio playback method according to another embodiment of the present invention.
Figure 6:
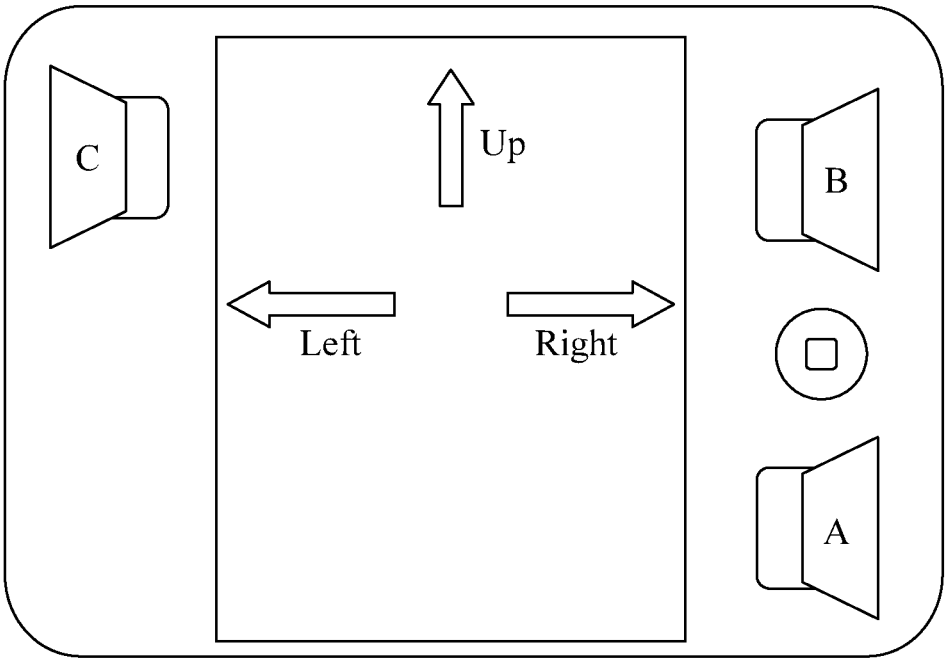
FIG. 6 is a fourth schematic diagram of an attitude of a mobile terminal implementing an audio playback method according to another embodiment of the present invention.

When a rotation angle of the mobile terminal is greater than a preset rotation threshold, content displayed on the screen of the mobile terminal rotates; specifically, for example, the mobile terminal uses the attitude 1 as a reference attitude; when the mobile terminal, using the attitude 1 as the reference attitude, rotates by an angle of more than 60 degrees, content displayed on the screen of the mobile terminal rotates by 90 degrees; as shown in FIG. 4, when the mobile terminal is in an attitude 2 after rotating clockwise by 90 degrees from the attitude 1, the content displayed on the screen of the mobile terminal also rotates by 90 degrees; when the mobile terminal, using the attitude 1 as the reference attitude, rotates by an angle of more than 150 degrees, the content displayed on the screen of the mobile terminal rotates by 180 degrees; as shown in FIG. 5, when the mobile terminal is in an attitude 3 after rotating clockwise by 180 degrees from the attitude 1, the content displayed on the screen of the mobile terminal also rotates by 180 degrees; and when the mobile terminal, using the attitude 1 as the reference attitude, rotates by an angle of more than 240 degrees, the content displayed on the screen of the mobile terminal rotates by 270 degrees; as shown in FIG. 6, when the mobile terminal is in an attitude 4 after rotating clockwise by 270 degrees from the attitude 1, the screen displaying of the mobile terminal also rotates by 270 degrees.

The spatial attitude information is information generated according to location information of the mobile terminal that is collected by the gravity sensor, and includes an angle, angular acceleration, and an angle change rate.

Step 302: Determine, according to the spatial attitude change rate and a preset rate threshold, whether a spatial attitude of the mobile terminal changes slowly; if the spatial attitude of the mobile terminal changes slowly, perform step 304, and otherwise, perform step 303.

Step 303: Select one pair of speakers from the three speakers according to the spatial attitude information, control a first speaker in the one pair of speakers to play a left audio channel, a second speaker in the one pair of speakers to play a right audio channel, and a remaining speaker except the one pair of speakers to be muted.

The first speaker is located on the left of currently played video information, and the second speaker is located on the right of the currently played video information.

For example, as shown in FIG. 2 and FIG. 4, when the mobile terminal changes from the attitude 1 to the attitude 2, it is obtained according to the spatial attitude information that the speaker A is located on the upper left of the mobile terminal, the speaker B is located on the lower left of the mobile terminal, and the speaker C is located on the lower right of the mobile terminal; the speaker B and the speaker C are selected as one pair; in this case, the speaker A is controlled to be muted, the speaker B is controlled to play the left audio channel, and the speaker C is controlled to play the right audio channel.

For example, as shown in FIG. 2 and FIG. 5, when the mobile terminal changes from the attitude 1 to the attitude 3, it is obtained according to the spatial attitude information that the speaker A is located on the upper right of the mobile terminal, the speaker B is located on the upper left of the mobile terminal, and the speaker C is located on the lower left of the mobile terminal; the speaker A and the speaker B are selected as one pair; in this case, the speaker C is controlled to be muted, the speaker B is controlled to play the left audio channel, and the speaker A is controlled to play the right audio channel.

For example, as shown in FIG. 2 and FIG. 6, when the mobile terminal changes from the attitude 1 to the attitude 4, it is obtained according to the spatial attitude information that the speaker A is located on the lower right of the mobile terminal, the speaker B is located on the upper right of the mobile terminal, and the speaker C is located on the upper left of the mobile terminal; the speaker A and the speaker C are selected as a pair; in this case, the speaker B is controlled to be muted, the speaker C is controlled to play the left audio channel, and the speaker A is controlled to play the right audio channel.

Step 304: If the spatial attitude of the mobile terminal changes slowly, control, according to the spatial attitude information and the spatial attitude change rate, volume of the left audio channel or the right audio channel that is played by each speaker, so that intensities of sound fields on the left and the right of the currently played video information keep equal in a volume change process.

It should be noted that, when screen rotation is performed on the mobile terminal, because the spatial attitude of the mobile terminal changes slowly, in an attitude change process, the three speakers are controlled to simultaneously play the left audio channel and the right audio channel, and the volume of the left audio channel and the right audio channel that are played by the speakers is controlled according to the spatial attitude information and the spatial attitude change rate.

For example, as shown in FIG. 2 and FIG. 4, in a process in which the mobile terminal changes slowly from the attitude 1 to the attitude 2, the speaker A, the speaker B, and the speaker C are all controlled to play the left audio channel and the right audio channel. In a process of the mobile terminal changing from the attitude 1 to the attitude 2, volume of both the left audio channel and the right audio channel that are played by the speaker A is controlled to decrease at a constant speed according to the spatial attitude change rate; volume of the left audio channel played by the speaker B is controlled to increase at a constant speed according to the spatial attitude change rate and volume of the right audio channel played by the speaker B is controlled to decrease at a constant speed according to the spatial attitude change rate; and volume of the left audio channel played by the speaker C is controlled to decrease at a constant speed according to the spatial attitude change rate and volume of the right audio channel played by the speaker C is controlled to increase at a constant speed according to the spatial attitude change rate. In a volume change process, superimposed volume of the volume of the left audio channel and the right audio channel that are played by the speaker A and the volume of the left audio channel and the right audio channel that are played by the speaker B is controlled to be equal to the volume of the left audio channel and the right audio channel that are played by the speaker C, so that the intensities of the sound fields on the left and the right of the currently played video information keep equal in the volume change process. Eventually, after the mobile terminal changes from the attitude 1 to the attitude 2, the volume of the left audio channel and the right audio channel that are played by the speaker A decreases to 0, that is, the speaker A is in a mute state; the volume of the right audio channel played by the speaker B decreases to 0, that is, the speaker B plays the left audio channel; and the volume of the left audio channel played by the speaker C decreases to 0, that is, the speaker C plays the right audio channel.

For example, as shown in FIG. 2 and FIG. 5, in a process in which the mobile terminal changes slowly from the attitude 1 to the attitude 3, the speaker A, the speaker B, and the speaker C are all controlled to play the left audio channel and the right audio channel. In a process in which the speaker A in the mobile terminal changes from the attitude 1 to the attitude 3, volume of the left audio channel played by the speaker A is controlled to decrease at a constant speed according to the spatial attitude change rate and volume of the right audio channel played by the speaker A is controlled to increase at a constant speed according to the spatial attitude change rate; volume of the left audio channel played by the speaker B is controlled to increase at a constant speed according to the spatial attitude change rate and volume of the right audio channel played by the speaker B is controlled to decrease at a constant speed according to the spatial attitude change rate; and volume of both the left audio channel and the right audio channel that are played by the speaker C is controlled to decrease at a constant speed according to the spatial attitude change rate. In a volume change process, superimposed volume of the volume of the left audio channel and the right audio channel that are played by the speaker C and the volume of the left audio channel and the right audio channel that are played by the speaker B is controlled to be equal to the volume of the left audio channel and the right audio channel that are played by the speaker A, so that the intensities of the sound fields on the left and the right of the currently played video information keep equal in the volume change process. Eventually, after the mobile terminal changes from the attitude 1 to the attitude 3, the volume of the left audio channel played by the speaker A decreases to 0, that is, the speaker A plays the right audio channel; the volume of the right audio channel played by the speaker B decreases to 0, that is, the speaker B plays the left audio channel; and the volume of the left audio channel and the right audio channel that are played by the speaker C decreases to 0, that is, the speaker C is in a mute state.

For example, as shown in FIG. 2 and FIG. 6, in a process in which the mobile terminal changes slowly from the attitude 1 to the attitude 4, the speaker A, the speaker B, and the speaker C are all controlled to play the left audio channel and the right audio channel. In a process in which the speaker A in the mobile terminal changes from the attitude 1 to the attitude 4, volume of the left audio channel played by the speaker A is controlled to decrease at a constant speed according to the spatial attitude change rate and volume of the right audio channel played by speaker A is controlled to increase at a constant speed according to the spatial attitude change rate; volume of both the left audio channel and the right audio channel that are played by the speaker B is controlled to decrease at a constant speed according to the spatial attitude change rate; and volume of the left audio channel played by the speaker C is controlled to increase at a constant speed according to the spatial attitude change rate and volume of the right audio channel played by the speaker C is controlled to decrease at a constant speed according to the spatial attitude change rate. In a volume change process, superimposed volume of the volume of the left audio channel and the right audio channel that are played by the speaker A and the volume of the left audio channel and the right audio channel that are played by the speaker B is controlled to be equal to the volume of the left audio channel and the right audio channel that are played by the speaker C, so that the intensities of the sound fields on the left and the right of the currently played video information keep equal in the volume change process. Eventually, after the mobile terminal changes from the attitude 1 to the attitude 4, the volume of the left audio channel played by the speaker A decreases to 0, that is, the speaker A plays the right audio channel; the volume of the left audio channel and the right audio channel that are played by the speaker B decreases to 0, that is, the speaker B is in a mute state; and the volume of the right audio channel played by the speaker C decreases to 0, that is, the speaker C plays the left audio channel.

In the audio playback method provided in the embodiment of the present invention, when screen rotation is performed on a mobile terminal, spatial attitude information is acquired, and audio content played by each speaker is controlled according to the spatial attitude information, so that a speaker located on the left of currently played video information plays a left audio channel, and a speaker located on the right of the currently played video information plays a right audio channel; in this way, the video information and the audio content that are currently played always correspond to each other. Compared with the prior art, the present invention controls, by acquiring the spatial attitude information of the mobile terminal, the audio content played by each speaker, so that the video information and the audio content that are currently played by the mobile terminal always correspond to each other, thereby resolving the problem in the prior art that the video information and the audio content that are currently played by the mobile terminal do not match when screen rotation is performed on the mobile terminal.

Figure 7:
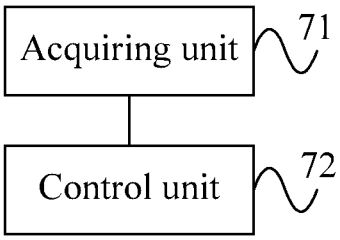
FIG. 7 is a schematic structural diagram of an audio playback apparatus according to an embodiment of the present invention.

As shown in FIG. 7, an audio playback apparatus provided in an embodiment of the present invention includes a spatial attitude sensor and at least three speakers, where the at least three speakers are not in a same straight line, and the audio playback apparatus further includes: an acquiring unit 71 configured to: when screen rotation is performed on a mobile terminal, acquire spatial attitude information, where the spatial attitude information is information generated according to spatial attitude location information of the mobile terminal that is collected by the spatial attitude sensor; and a specific implementation manner of the acquiring unit 71 is the same as step 101 shown in FIG. 1, so the details are not described herein again, where the spatial attitude information includes an angle, angular acceleration, and an angle change rate; and the spatial attitude sensor includes, but is not limited to, a gravity sensor, a magnetic sensor, and the like; and a control unit 72 configured to control, according to the spatial attitude information acquired by the acquiring unit, audio content played by each speaker, so that a speaker located on the left of currently played video information plays a left audio channel, and a speaker located on the right of the currently played video information plays a right audio channel; and a specific implementation manner of the control unit 72 is the same as step 102 shown in FIG. 1, so the details are not described herein again.

Figure 8:
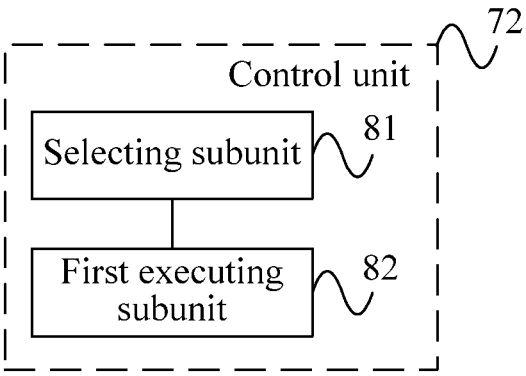
FIG. 8 is a first schematic structural diagram of a control unit in the schematic structural diagram shown in FIG. 7.

As shown in FIG. 8, the control unit 72 includes: a selecting subunit 81 configured to select at least one pair of speakers from the at least three speakers according to the spatial attitude information acquired by the acquiring unit; and a specific implementation manner of the selecting subunit 81 is the same as step 303 shown in FIG. 3, so the details are not described herein again; and a first executing subunit 82 configured to control a first speaker in the at least one pair of speakers selected by the selecting subunit to play the left audio channel, and control a second speaker in the at least one pair of speakers to play the right audio channel, where the first speaker is located on the left of the currently played video information, and the second speaker is located on the right of the currently played video information; and a specific implementation manner of the first executing subunit 82 is the same as step 303 shown in FIG. 3, so the details are not described herein again.

Figure 9:
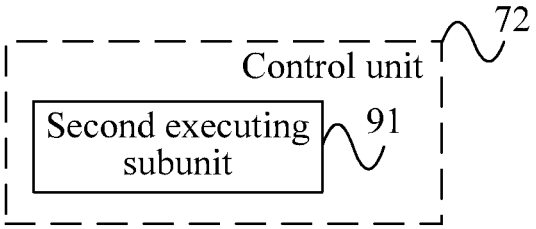
FIG. 9 is a second schematic structural diagram of a control unit in the schematic structural diagram shown in FIG. 7.

Further, as shown in FIG. 9, the control unit 72 further includes: a second executing subunit 91 configured to: if the at least three speakers further include a remaining speaker in addition to the at least one pair of speakers selected by the selecting subunit, control the remaining speaker so that the remaining speaker is muted; and a specific implementation manner of the second executing subunit 91 is the same as step 303 shown in FIG. 3, so the details are not described herein again.

Figure 10:
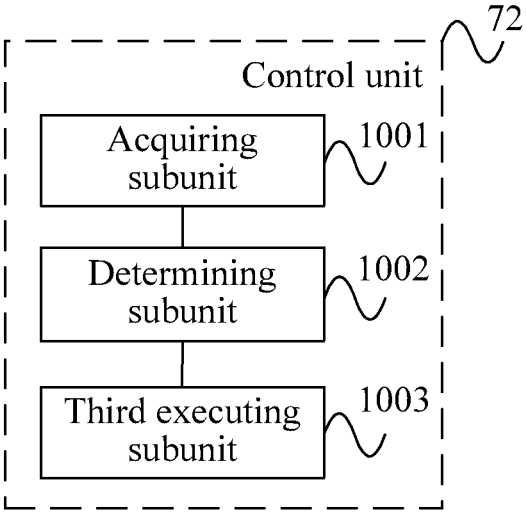
FIG. 10 is a third schematic structural diagram of a control unit in the schematic structural diagram shown in FIG. 7.

As shown in FIG. 10, the control unit 72 further includes: an acquiring subunit 1001 configured to acquire a spatial attitude change rate; and a specific implementation manner of the acquiring subunit 1001 is the same as step 301 shown in FIG. 3, so the details are not described herein again; a determining subunit 1002 configured to determine, according to the spatial attitude change rate acquired by the acquiring subunit and a preset rate threshold, whether a spatial attitude of the mobile terminal changes slowly; and a specific implementation manner of the determining subunit 1002 is the same as step 302 shown in FIG. 3, so the details are not described herein again; where if the determining subunit determines that the spatial attitude of the mobile terminal changes slowly, a third executing subunit 1003 is forwarded to; and if the determining subunit determines that the spatial attitude of the mobile terminal changes normally, the selecting subunit 81 is forwarded to; and the third executing subunit 1003 configured to: if the determining subunit determines that the spatial attitude of the mobile terminal changes slowly, control, according to the spatial attitude information and the spatial attitude change rate, volume of the left audio channel or the right audio channel that is played by each speaker in the at least three speakers, so that intensities of sound fields on the left and the right of the currently played video information keep equal in a volume change process; and a specific implementation manner of the third executing subunit 1003 is the same as step 304 shown in FIG. 3, so the details are not described herein again.

In the audio playback apparatus provided in the embodiment of the present invention, when screen rotation is performed on a mobile terminal, spatial attitude information is acquired, and audio content played by each speaker is controlled according to the spatial attitude information, so that a speaker located on the left of currently played video information plays a left audio channel, and a speaker located on the right of the currently played video information plays a right audio channel; in this way, the video information and the audio content that are currently played always correspond to each other. Compared with the prior art, the present invention controls, by acquiring the spatial attitude information of the mobile terminal, the audio content played by each speaker, so that the video information and the audio content that are currently played by the mobile terminal always correspond to each other, thereby resolving the problem in the prior art that the video information and the audio content that are currently played by the mobile terminal do not match when screen rotation is performed on the mobile terminal.

Figure 11:
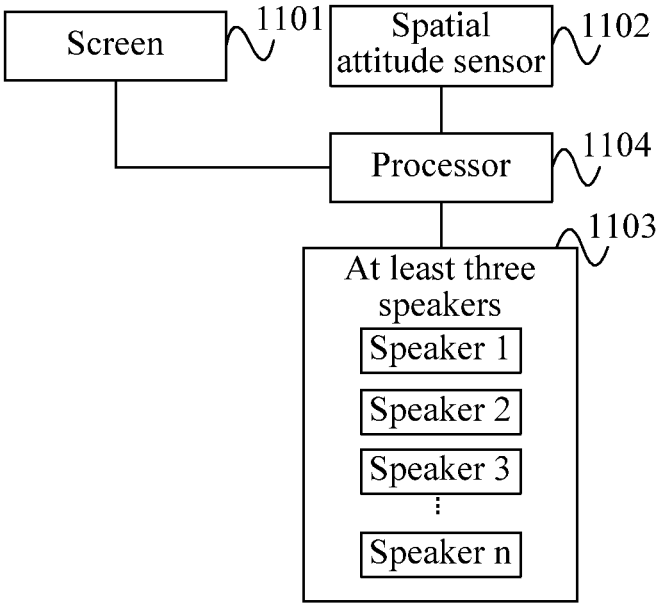
FIG. 11 is a schematic structural diagram of a mobile terminal according to an embodiment of the present invention.

As shown in FIG. 11, another embodiment of the present invention provides a mobile terminal, including a screen 1101, a spatial attitude sensor 1102, at least three speakers 1103, and a processor 1104.

The screen 1101 is configured to display video information played by the mobile terminal.

The spatial attitude sensor 1102 is configured to collect spatial attitude information of the mobile terminal.

The at least three speakers 1103 are configured to output audio content played by the mobile terminal.

The at least three speakers 1103 include: a speaker 1, a speaker 2, a speaker 3 . . . , and a speaker n.

The processor 1104 is configured to control, according to the spatial attitude information, audio content played by each speaker, so that a speaker located on the left of the mobile terminal plays a left audio channel, and a speaker located on the right of the mobile terminal plays a right audio channel.

The spatial attitude information is information generated according to location information of the mobile terminal that is collected by the spatial attitude sensor.

In this embodiment, the processor 1104 is specifically configured to: determine, according to a spatial attitude change rate and a preset rate threshold, whether a spatial attitude of the mobile terminal changes slowly; if the spatial attitude of the mobile terminal changes slowly, control, according to the spatial attitude information and the spatial attitude change rate, volume of the left audio channel or the right audio channel that is played by each speaker in the at least three speakers; otherwise, select at least one pair of speakers from the at least three speakers according to the spatial attitude information, control a first speaker in the at least one pair of speakers to play the left audio channel, and control a second speaker in the at least one pair of speakers to play the right audio channel, where the first speaker is located on the left of currently played video information, and the second speaker is located on the right of the currently played video information; and if the at least three speakers further include a remaining speaker in addition to the at least one pair of speakers, control the remaining speaker so that the remaining speaker is muted.

In the mobile terminal provided in the embodiment of the present invention, when screen rotation is performed on the mobile terminal, spatial attitude information is acquired, and audio content played by each speaker is controlled according to the spatial attitude information, so that a speaker located on the left of the video information currently played by the mobile terminal plays a left audio channel, and a speaker located on the right of the video information currently played by the mobile terminal plays a right audio channel; in this way, the video information and the audio content that are currently played by the mobile terminal always correspond to each other. Compared with the prior art, the present invention controls, by acquiring the spatial attitude information of the mobile terminal, the audio content played by each speaker, so that the video information and the audio content that are currently played by the mobile terminal always correspond to each other, thereby resolving the problem in the prior art that the video information and the audio content that are currently played by the mobile terminal do not match when screen rotation is performed on the mobile terminal.

Based on the foregoing descriptions of the embodiments, a person skilled in the art may clearly understand that the present invention may be implemented by hardware, firmware, or a combination thereof. If the present invention is implemented by software, the foregoing functions may be stored in a computer-readable medium or are transmitted to the computer-readable medium in a form of one or more instructions or code. The computer-readable medium is either a computer storage medium or a communications medium that enables a computer program to move from one place to another place. The storage medium may be any available medium that may be accessed by a computer. For example, such a computer-readable medium may include, but is not limited to a random-access memory (RAM), a read-only memory (ROM), an electrically erasable programmable ROM (EEPROM), a compact disk ROM (CD-ROM) or another optical disc, or a disk storage or another magnetic storage device, or any other medium that may be used to bear or store program code and can be accessed by any a computer, where the program code is in an expected form of an instruction or a data structure. In addition, any connection may be appropriately defined as a computer-readable medium. For example, if software is transmitted from a website, a server, or another remote source by using a coaxial cable, an optical fiber cable, a twisted pair, a digital subscriber line (DSL) or a wireless technology, such as infrared, radio, or microwave, the coaxial cable, the optical fiber cable, the twisted pair, or the wireless technology, such as infrared, radio, and microwave, are included in the defined medium. The disk and the disc include a compact disk (CD), a laser disk, an optical disc, a digital versatile disc (DVD), a floppy disk, and a blue-ray disk. The disk generally copies data by a magnetic means, and the disc generally copies data optically by a laser means. The foregoing combination may also be included in the computer-readable medium.

The foregoing descriptions are merely specific implementation manners of the present invention, but are not intended to limit the protection scope of the present invention. Any variation or replacement readily figured out by a person skilled in the art within the technical scope disclosed in the present invention shall fall within the protection scope of the present invention. Therefore, the protection scope of the present invention shall be subject to the protection scope of the claims.

What is claimed is:

1. An audio playback method, applied to a mobile terminal that has a spatial attitude sensor, wherein the mobile terminal comprises at least three speakers, and the at least three speakers are not in a same straight line, the method comprising:

acquiring spatial attitude information when screen rotation is performed on the mobile terminal, wherein the spatial attitude information is information generated according to spatial attitude location information of the mobile terminal that is collected by the spatial attitude sensor, and wherein the spatial attitude information comprises an angle, angular acceleration, and an angle change rate; and controlling, according to the spatial attitude information, audio content played by each speaker, so that a speaker located on the left of currently played video information plays a left audio channel, and a speaker located on the right of the currently played video information plays a right audio channel.

2. The method according to claim 1, wherein controlling, according to the spatial attitude information, the audio content played by each speaker comprises:

selecting at least one pair of speakers from the at least three speakers according to the spatial attitude information;

controlling a first speaker in the at least one pair of speakers to play the left audio channel; and controlling a second speaker in the at least one pair of speakers to play the right audio channel, wherein the first speaker is located on the left of the currently played video information, and wherein the second speaker is located on the right of the currently played video information.

3. The method according to claim 2, wherein controlling, according to the spatial attitude information, the audio content played by each speaker further comprises controlling the remaining speaker so that the remaining speaker is muted when the at least three speakers further include a remaining speaker in addition to the at least one pair of speakers.

4. The method according to claim 1, wherein controlling, according to the spatial attitude information, the audio content played by each speaker comprises:

acquiring a spatial attitude change rate;

determining, according to the spatial attitude change rate and a preset rate threshold, whether a spatial attitude of the mobile terminal changes slowly; and controlling, according to the spatial attitude information and the spatial attitude change rate, volume of the left audio channel or the right audio channel that is played by each speaker in the at least three speakers when the spatial attitude of the mobile terminal changes slowly, so that intensities of sound fields on the left and the right of the currently played video information are equal in a volume change process.

5. A mobile terminal comprising:

a spatial attitude sensor;

at least three speakers, wherein the at least three speakers are not in a same straight line; and a computer processor configured to:

acquire spatial attitude information when screen rotation is performed on the mobile terminal, wherein the spatial attitude information is information generated according to spatial attitude location information of the mobile terminal that is collected by the spatial attitude sensor, and wherein the spatial attitude information comprises an angle, angular acceleration, and an angle change rate; and control, according to the spatial attitude information, audio content played by each speaker, so that a speaker located on the left of currently played video information plays a left audio channel, and a speaker located on the right of the currently played video information plays a right audio channel.

6. The mobile terminal according to claim 5, wherein the computer processor is configured to:

select at least one pair of speakers from the at least three speakers according to the spatial attitude information;

control a first speaker in the at least one pair of speakers selected by the selecting subunit to play the left audio channel; and control a second speaker in the at least one pair of speakers to play the right audio channel, wherein the first speaker is located on the left of the currently played video information, and wherein the second speaker is located on the right of the currently played video information.

7. The mobile terminal according to claim 6, wherein the computer processor is configured to control a remaining speaker so that the remaining speaker is muted when the at least three speakers further include the remaining speaker in addition to the at least one pair of speakers.

8. The mobile terminal according to claim 5, wherein the computer processor is configured to:

acquire a spatial attitude change rate;

determine, according to the spatial attitude change rate and a preset rate threshold, whether a spatial attitude of the mobile terminal changes slowly; and control, according to the spatial attitude information and the spatial attitude change rate, volume of the left audio channel or the right audio channel that is played by each speaker in the at least three speakers when determining that the spatial attitude of the mobile terminal changes slowly, so that intensities of sound fields on the left and the right of the currently played video information are equal in a volume change process.

* * * * *